United States Patent [19]

King

[11] 4,133,729

[45] Jan. 9, 1979

[54] PRODUCTION OF 1,2-BIS(HYDROXY-PHENYL)ETHANE-1,2-DIOLS BY ELECTROLYTIC REDUCTION

[75] Inventor: Christopher J. H. King, Pensacola, Fla.

[73] Assignee: Monsanto Company, St. Louis, Mo.

[21] Appl. No.: 861,793

[22] Filed: Dec. 19, 1977

[51] Int. Cl.[2] ..... C25B 3/04

[52] U.S. Cl. ..... 204/75; 204/73 R; 568/644; 568/729

[58] Field of Search ..... 204/73 R, 75, 77; 260/619 B, 613 R

[56] References Cited

U.S. PATENT DOCUMENTS

| | | | |
|---|---|---|---|
| 3,899,401 | 8/1975 | Nohe et al. | 204/73 R |
| 4,087,336 | 5/1978 | Wagenknecht | 204/75 |

OTHER PUBLICATIONS

J. Grimshaw et al., J. Chemical Soc., (*c*), pp. 653–655, (1966).

*Primary Examiner*—G. L. Kaplan
*Attorney, Agent, or Firm*—Thomas Y. Awalt, Jr.

[57] ABSTRACT

The product 1,2-bis(hydroxyphenyl)ethane-1,2-diol of electrolytic reductive coupling of hydroxybenzaldehyde is recovered by purging the electrolyte solution and extracting the 1,2-bis(hydroxyphenyl)ethane-1,2-diol, leaving a product extraction residue which may be used as an essential portion of the electrolyte solution.

13 Claims, No Drawings

PRODUCTION OF 1,2-BIS(HYDROXY-PHENYL)ETHANE-1,2-DIOLS BY ELECTROLYTIC REDUCTION

BACKGROUND OF THE INVENTION

A. Field of the Invention

The invention relates to the electrolytic reduction of hydroxybenzaldehydes to produce the corresponding 1,2-bis(hydroxyphenyl)ethane-1,2-diol (dihydroxybenzoin). More particularly, the invention relates to the electrolytic reductive coupling of hydroxybenzaldehydes by electrolysis in an aqueous electrolysis medium in an undivided electrolytic cell to produce 1,2-bis(hydroxyphenyl)ethane-1,2-diols, and to the recovery of the product diol.

B. The Prior Art

Electrolytic reductive coupling of hydroxybenzaldehydes to prepare the corresponding 1,2-bis(hydroxyphenyl) ethane-1,2-diols has previously been accomplished in good yields. See, for example, Grimshaw et al., *Journal of the Chemical Society* (C), 653 (1966). However, each of the methods described in the prior art employed a divided cell. A divided cell is inherently more complex than an individed cell, thereby involving higher costs in cell construction. A divided cell exhibits a higher internal resistance than an undivided cell resulting in substantially higher power costs. Efforts to adapt such divided-cell electrolytic methods of preparing 1,2-bis(hydroxyphenyl)ethane-1,2-diols to commercial production on a large technical scale have been severely limited by the above considerations.

One of the difficulties initially encountered in the use of undivided cells for such electrolytic reductive coupling was that recovery of the product diol from the electrolytic solution was cumbersome, slow, and in practice resulted in destruction of the effectiveness of the electrolyte solution from which the product diols were extracted.

A practical combination of a workable undivided cell electrolytic reductive coupling process for the preparation of 1,2-bis(hydroxyphenyl)ethane-1,2-diol with an effective recovery of the diol in such a manner as to permit reuse of the solution from which the product diol is recovered, would be a significant advance in the art and is an object of this invention.

SUMMARY OF THE INVENTION

The invention is a process for the electrolytic reductive coupling of hydroxybenzaldehydes to produce the corresponding 1,2-bis(hydroxyphenyl)ethane-1,2-diol by electrolyzing in an undivided reaction cell an aqueous electrolyte solution of the hydroxybenzaldehyde to be coupled. The aqueous solution is maintained at a concentration of the hydroxybenzaldehyde of about 2–10% by weight, at a pH of about 10.5–14 and in contact with a cathodic surface having a cathode potential sufficient for electrolytic reduction of the hydroxybenzaldehyde. At least a small portion of the aqueous solution is purged and the 1,2-bis(hydroxyphenyl) ethane-1,2-diol is extracted with an aldehyde precipitant (preferably a hydroxybenzaldehyde). Addition of the aldehyde precipitant lowers the pH to below about 10.5 and causes precipitation of the product diol, which may be recovered by filtration, leaving a product extraction residue suitable for continued use as an essential portion of the electrolyte solution. The product extraction residue may be recycled as needed to the electrolyte solution, thereby offsetting the inherent pH rise which takes place during the electrolytic reaction. The electrolyte solution may be adjusted intermittently if required, with an inorganic base to a pH of about 10.5–14.

DETAILED DESCRIPTION OF THE INVENTION

Electrolytic reductive coupling of hydroxybenzaldehydes in an undivided cell produces 1,2-bis(hydroxyphenyl)-ethane-1,2-diols.

In accordance with the present process, an electric current is passed through an aqueous alkaline electrolysis medium comprising the hydroxybenzaldehyde and aqueous solvent in an undivided cell.

The hydroxybenzaldehydes suitable for use in the present process are represented by the formula:

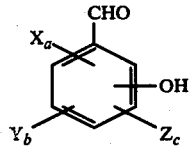

wherein X represents alkyl of 1 to 6 carbon atoms; Y represents alkoxy containing an alkyl of 1 to 6 carbon atoms; Z represents any non-interfering substituent, excluding alkyl and alkoxy; and *a, b,* and *c* each independently represent an integer from 0 (zero) to 4, inclusive, with the proviso that the sum of *a, b,* and *c* does not exceed 4.

The term "non-interfering substituent" is employed herein to mean a substituent which can be present in the hydroxybenzaldehyde without causing substantial adverse alteration of either the course of the desired reductive coupling of such hydroxybenzaldehydes nor the yield of the desired product under process conditions.

Representative of hydroxybenzaldehydes suitable for use in the present process are 2-hydroxybenzaldehyde (o-hydroxybenzaldehyde, 3-hydroxybenzaldehyde (m-hydroxybenzaldehyde), 4-hydroxybenzaldehyde (p-hydroxybenzaldehyde), 2-hydroxy-3-methylbenzaldehyde, 3-hydroxy-5-methylbenzaldehyde, 4-hydroxy-3-methylbenzaldehyde, 2-hydroxy-3-ethylbenzaldehyde, 3-hydroxy-5-ethylbenzaldehyde, 4-hydroxy-3-ethylbenzaldehyde, 2-hydroxy-3-n-butylbenzaldehyde, 3-hydroxy-5-n-butylbenzaldehyde, 4-hydroxy-3-n-butylbenzaldehyde, 2-hydroxy-3-i-butylbenzaldehyde, 3-hydroxy-5-i-butylbenzaldehyde, 4-hydroxy-3-i-butylbenzaldehyde, 2-hydroxy-3-n-hexylbenzaldehyde, 3-hydroxy-5-n-hexylbenzaldehyde, 4-hydroxy-3-n-hexylbenzaldehyde, 2-hydroxy-3-methoxybenzaldehyde, 3-hydroxy-5-methoxybenzaldehyde, 4-hydroxy-3-methoxybenzaldehyde (vanillin), 2-hydroxy-3-ethoxybenzaldehyde, 3-hydroxy-5-ethoxybenzaldehyde, 4-hydroxy-3-ethoxybenzaldehyde, 2-hydroxy-3-n-butoxy-benzaldehyde, 3-hydroxy-5-n-butoxybenzaldehyde, 4-hydroxy-3-n-butoxybenzaldehyde, 2-hydroxy-3-n-hexoxybenzaldehyde, 3-hydroxy-5-n-hexoxybenzaldehyde, 4-hydroxy-3-n-hexoxybenzaldehyde, 2-hydroxy-3-methoxy-5-methylbenzaldehyde, 4-hydroxy-3-methoxy-5-methylbenzaldehyde, and the like. Of these, 4-hydroxybenzaldehyde is particularly important in that the coupled product therefrom, 1,2-bis-(4-hydroxyphenyl)ethane-1,2-diol (4,4'-dihydroxyhydrobenzoin), can readily be converted to 1,2-bis-(4-hydroxyphenyl)ethane which is very useful as an antioxidant and as a symmetrical bifunctional intermediate in the preparation of epoxy resins, polycarbonates, polyesters, and the like. It is, of course, apparent that the corresponding products from other suitable hydroxybenzaldehydes may be similarly employed even though they may not be symmetrical.

In carrying out the present process, a hydroxybenzaldehyde is charged to an undivided electrolytic cell fitted with a cathode and an anode, and an electromotive force is impressed upon the cell whereby the hydroxybenzaldehyde undergoes electrolytic reductive coupling to yield a 1,2-bis(hydroxyphenyl)ethane-1,2-diol in which the coupling occurs at the aldehyde functionality. The reaction involved can be illustrated as follows:

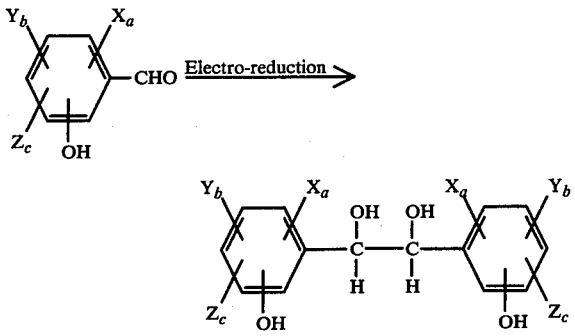

wherein X, Y, and Z, and *a*, *b*, and *c* are as defined hereinabove.

The electrolysis is carried out in an aqueous electrolysis medium having a pH of about 10.5–14 which permits the reduction to occur at the cathode without simultaneously effecting an undesired oxidative coupling at the anode, even though the medium obviously is in contact with both cathode and anode. At a pH of about 10.5–14 and at concentrations of the hydroxybenzaldehyde described, the product diol will remain in solution. A preferred pH range is 10.5–12.

In an exemplary method of conducting the present process, a solution of the hydroxybenzaldehyde (about 2.0 percent to about 10 percent by weight, or on a molar basis, about 0.1 molar to about 0.5 molar) dissolved in aqueous sodium hydroxide (about 2.0 percent to about 30 percent, or on a molar basis, about 0.5 molar to about 7.5 molar, and usually about 5 percent to about 20 percent, or on a molar basis about 1.0 molar to about 5.0 molar) is charged to an undivided electrolytic cell maintained at a temperature between about 20° C. and about 60° C. and having a steel, lead (IV) oxide, noble metal oxide, carbon, or graphite anode and a lead, cadmium, or mercury cathode. Other suitable bases can be employed in the same or similar concentration ranges so long as the base to hydroxybenzaldehyde molar ratio is at least 1:1. An electric current is then impressed on the cell by connecting the anode and cathode to a proper source of direct current with controls to maintain the current density at between about 0.01 and 200 or more milliamperes per square centimeter for a time sufficient to cause reductive coupling of the hydroxybenzaldehyde to the corresponding 1,2-bis(hydroxyphenyl)ethane-1,2-diol, which then is isolated as described hereinbelow.

The concentration of the hydroxybenzaldehyde compound employed in the process of the present invention is critical to the control of solubility of the product diol by means of regulating pH. A concentration of about 2–10% is workable and a concentration of 6–10% is preferred. At concentrations of the hydroxybenzaldehyde in excess of about 10% by weight the product diol may precipitate in the cell at pH's in excess of 10.5. While precipitation in the cell may be involved in an acceptable manner of conducting a reductive coupling process, it does not fall within the scope of this invention which is limited to a process in which the product diol is precipitated and recovered externally of the cell.

The temperature at which the process of the instant invention is conducted is not narrowly critical and can range from as low as 0° C. to as high as 80° C. As is apparent to those skilled in the art, at lower temperatures a very dilute solution must be employed since the solubility of hydroxybenzaldehyde starting material is lower at lower temperatures. For this reason, it is generally preferred to employ temperatures between about 20° C. and about 60° C., and usually between about 25° C. and about 50° C.

The process of the present invention can be conducted at atmospheric pressure, super atmospheric pressures, and subatmospheric pressures. For reasons of economy and ease of construction of the equipment employed in the present process, it is preferred to conduct this process at atmospheric pressure.

The current densities employed in the process of the present invention can range from as low as 0.001 ampere (1.0 milliampere) per square centimeter to 0.5 amperes (500 milliamperes) per square centimeter of cathode surface area.

The type of electrolytic cell employed in the process of the instant invention is not critical. The cell can consist of a glass container having one or more anodes and cathodes connected to a source of direct electric current such as a battery and the like. The cell can also consist of the two electrodes separated by an insulator such as a rubber or other non-conducting gasket or spacer. In such a cell, which is conveniently described as a "sandwich-type" electrolytic cell, the electrolysis medium is preferably flowed past the (two) parallel electrodes (cathode and anode) in a recirculating system. Such as arrangement allows large volumes of the electrolysis medium to be effectively subjected to electrolysis in a relatively small cell having the preferred closely-spaced electrode surfaces.

The electrodes, that is, the anode and cathode, employed in the process of the present invention can be constructed of a wide variety of conductive materials. Thus, anode materials suitable for use in the present process include, for example, steel, lead (IV) oxide, noble metal oxide carbon, graphite, and the like, with steel generally being preferred because of its greater stability against corrosion. Anodes comprising noble metal oxides are commonly known as "dimensionally stable (DSA) anodes".

The cathodes can also be of any conductive substances so long as such substances do not cause, to any significant extent, undesired side reactions, such as reduction of the aldehyde functionality to the corresponding alcohol functionality. For example, lead, cadmium, and mercury cathodes are suitable.

The inorganic bases which can be employed to render the aqueous electrolysis medium alkaline or basic include the alkali metal oxides and hydroxides such as, for example, sodium, potassium, rubidium, and cesium, oxides and hydroxides.

In general, the alkali metal hydroxides, for example, sodium hydroxide, are preferred for use as the base in the present process for economic reasons. However, it will be recognized that in certain instances the quaternary ammonium hydroxides might be preferred due to the greater solubility of the hydroxybenzaldehydes in such solution.

The present process is suited to either batch or continuous operations. Continuous operations can involve recirculation of a flowing electrolyte stream, or streams between the electrodes, with continuous or intermittent sampling of the stream for product removal. Additional reactants can also be added continuously or intermittently, and other electrolyte components can be augmented, replenished, or removed as appropriate.

The aqueous alkaline electrolysis medium must have sufficient conductivity to support the electrolysis current. While media of less than ideal conductivity can be employed, it is preferred from an economic viewpoint not to have too high a resistance. The conductivity can, if desired, be enhanced by the addition of common supporting electrolytes such as electrolyte salts having sufficiently high discharge potentials to the aqueous alkaline electrolysis medium. In general, however, with the combination of hydroxybenzaldehyde, base, and aqueous solvent employed in the present process, the addition of a supporting electrolyte to the electrolysis medium is not actually necessary, or even desirable.

The term "supporting electrolyte" as employed herein is an electrolyte capable of carrying electric current but not discharging under electrolysis conditions. It will be recognized, of course, that discharge potentials will vary with electrode materials and their surface conditions and various materials in the electrolysis medium.

The term "salt" is employed in its generally recognized sense to indicate a compound composed of a cation and an anion, such as produced by the reaction of an acid with a base.

The supporting electrolytes which can be employed to enhance the conductivity of the aqueous alkaline electrolysis medium include alkali metal and quaternary ammonium phosphates, perchlorates, carbonates, tetrafluoroborates, hexafluorophosphates, and the like. Specific examples of such supporting electrolytes are salts such as sodium, potassium, rubidium, and cesium phosphates, sodium, potassium, rubidium, and cesium perchlorates, sodium, potassium, rubidium, and cesium carbonates, sodium, potassium, rubidium, and cesium tetrafluoroborates, sodium, potassium, rubidium, and cesium hexafluorophosphates, and the like.

The concentration of electrolyte salts, when used, can vary widely, for example, from about 0.5 percent to about 30 percent or more by weight of the electrolysis medium, but suitable concentrations will often be in the range of about 1.0 percent to about 15 percent by weight or, on a molar basis, often in the range of about 0.1 molar to about 1.0 molar. If, however, it is desired to have all the components in solution, which state is preferred, the amount of electrolyte salt utilized will be no greater than will dissolve in the electrolysis medium.

After or during the course of the reaction, the aqueous electrolyte solution may be removed from the reaction cell and subjected to extraction with an aldehyde precipitant. The aldehyde precipitant is preferably the same hydroxybenzaldehyde which is used as the starting material in the reaction. Extraction with a hydroxybenzaldehyde results in a lowering of the pH of the electrolyte solution to below about 10.5, at which point the 1,2-bis(hydroxyphenyl)ethane-1,2-diol is precipitated out and collected by filtration or other conventional means of separation. Ordinarily the product extraction residue which is left behind will not require adjustment of pH corresponding to that of the original aqueous electrolyte because its recycle to the electrolyte solution will approximately offset the inherent rise of pH in the cell during the reaction. If adjustment of the pH is needed over a long continuous reaction, it may be accomplished by addition of an inorganic base, preferably an alkali metal hydroxide such as sodium hydroxide either to the product extraction residue or to the reconstituted electrolyte solution.

EXAMPLE

An aqueous electrolyte containing 10% by weight of p-hydroxybenzaldehyde is adjusted to a pH of 10.5–11 with NaOH and charged to a container holding a cathode surfaced with mercury and an anode surfaced with a noble metal oxide, and maintained at a temperature of 50° C. and a cell voltage of about 5 volts is applied across the electrodes. A stream of the electrolyte containing the product diol is removed from the cell and, in a separate vessel, mixed with p-hydroxybenzaldehyde in a sufficient amount to lower the pH below about 10.5. When the pH is lowered below about 10.5, the product diol precipitates from solution and is removed by filtration. The remaining product extraction residue is returned to the cell as required to maintain the 10% by weight concentration. The effect of the return to the cell of product extraction residue at a lower pH approximately offsets the inherent rise of pH in the cell during the reaction.

We claim:

1. A process for the electrolytic reduction of hydroxybenzaldehydes to produce the corresponding 1,2-bis(-hydroxyphenyl)ethane-1,2-diol which comprises electrolyzing in an undivided reaction cell an aqueous electrolyte solution comprising the hydroxybenzaldehyde at a weight % concentration of about 2–10% of the aqueous solution, the aqueous solution being at a pH of about 10.5–14 and in contact with a cathodic surface having a cathode potential sufficient for electrolytic reduction of the hydroxybenzaldehyde, purging the aqueous solution, and recovering the 1,2-bis(hydroxyphenyl)ethane-1,2-diol by extracting with an aldehyde precipitant, leaving a product extraction residue suitable for continued use as an essential portion of the electrolyte solution.

2. The process of claim 1 wherein the weight concentration of hydroxybenzaldehyde in the aqueous electrolyte solution is about 6–10%.

3. The process of claim 1 wherein the pH of the aqueous electrolyte solution is about 10.5–12.

4. The process of claim 1 wherein the hydroxybenzaldehyde is p-hydroxybenzaldehyde.

5. The process of claim 1 wherein the aldehyde precipitant is p-hydroxybenzaldehyde.

6. The process of claim 1 wherein the aqueous electrolyte solution also contains an inorganic base.

7. The process of claim 6 wherein the inorganic base is an alkali metal hydroxide.

8. The process of claim 7 wherein the alkali metal hydroxide is sodium hydroxide.

9. In a process for the electrolytic reduction of hydroxybenzaldehyde to produce the corresponding 1,2-bis(hydroxyphenyl)ethane-1,2-diol which comprises electrolyzing in an undivided reaction cell an aqueous electrolyte solution comprising the hydroxybenzaldehyde and an aqueous solvent, the aqueous solution being in contact with a cathodic surface having a cathode potential sufficient for electrolytic reduction of the hydroxybenzaldehyde, the improvement comprising maintaining the aqueous electrolyte solution at a weight concentration of the hydroxybenzaldehyde of about 2–10% and a pH of about 10.5–14, purging the aqueous solution, extracting with an aldehyde precipitant the aqueous solution thereby recovering the 1,2-bis(hydroxyphenyl)ethane-1,2-diol, leaving a product extraction residue suitable for continued use as an essential portion of the electrolyte solution.

10. The process improvement of claim 9 wherein the hydroxybenzaldehyde is p-hydroxybenzaldehyde.

11. The process of claim 9 wherein the aldehyde precipitant is p-hydroxybenzaldehyde.

12. The process improvement of claim 11 wherein the weight concentration of hydroxybenzaldehyde in the aqueous electrolyte solution is about 6–10%.

13. The process improvement of claim 11 wherein the pH of the aqueous electrolyte solution is about 10.5–12.

* * * * *